US005398536A

United States Patent [19]

Schlatter

[11] Patent Number: 5,398,536

[45] Date of Patent: Mar. 21, 1995

[54] WOBBLE PRESS

[76] Inventor: Walter Schlatter, Wiesengasse 69, FL-9494 Schaan, Liechtenstein

[21] Appl. No.: 30,039

[22] PCT Filed: Jul. 22, 1992

[86] PCT No.: PCT/CH92/00151

§ 371 Date: Apr. 1, 1993

§ 102(e) Date: Apr. 1, 1993

[87] PCT Pub. No.: WO93/01906

PCT Pub. Date: Feb. 4, 1993

[30] Foreign Application Priority Data

Jul. 22, 1991 [CH] Switzerland ..... 2214/91

[51] Int. Cl.[6] ..... B21J 7/20; B21J 13/00

[52] U.S. Cl. ..... 72/406; 72/67

[58] Field of Search ..... 72/406, 67, 112, 115

[56] References Cited

U.S. PATENT DOCUMENTS 4,984,443 1/1991 Sato ..... 72/406

FOREIGN PATENT DOCUMENTS 1652653 5/1972 Germany .
52848 4/1977 Japan ..... 72/406
284452 11/1989 Japan ..... 72/67
317650 12/1989 Japan ..... 72/67
0051954 11/1966 Poland .
0662983 11/1987 Switzerland .
0666857 8/1988 Switzerland .
1005990 3/1983 U.S.S.R. ..... 72/406

OTHER PUBLICATIONS

Patent Abstracts of Japan, vol. 14, No. 58 (M-930) (4001) 2.

*Primary Examiner*—Daniel C. Crane
*Attorney, Agent, or Firm*—Sandler, Greenblum & Bernstein

[57] ABSTRACT

In a wobble press with a first wobbling die-half (1) and an axially parallel moving second half-die (2), the wobbling motion is generated by a plurality of hydraulically actuated working pistons (5) cyclically engaging with the wobbling half-die (1). By means of the elimination of centrifugal forces by a counterweight (G) connected to the wobbling half-die (1), the precise guiding of the die-halves (1,2) by a centering disk (17) and the avoidance of a mechanical drive by using a multiple-pistons pump (20) and a hydraulic control system for the working pistons (5), it is possible to reduce undesirable rotary forces, vibration, friction and heat generation in such a way that substantially higher wobble frequencies and shorter processing times are attained at lower cost while maintaining the geometrical wobble effect owing to the higher wobble frequency, with a simple and rapidly acting control of the extent and form of higher wobble frequency, with a simple and rapidly acting control of the extent and form of the wobbling movement even during operation, thus making it possible to preselect the most suitable pressing program.

12 Claims, 4 Drawing Sheets

WOBBLE PRESS

TECHNICAL FIELD

This invention pertains to a wobble press having a first die half which is driven by a drive relative to a space axis, wobbly around a fulcrum point, and which includes a movable second half die axially parallel relative to the first die half wherein the wobble drive includes hydraulic working pistons which are provided with a regular, defined, pulsating flow of a hydraulic medium and which on their part are connected with the first die half for the generation of a wobble movement.

STATE OF THE ART

Such a wobble press is, for example, known in CH 662983, CH 666857 or DE 1652653 and serves for the production of massive parts of metal or other rigid materials, wherein the part or the workpiece is formed between two enveloping tools or die parts wherein, in opposition to the parallel axial press methods the one die half carries out a rolling type of wobbly movement. Due to the partial contact of the upper die with the workpiece material the workpiece material can, via the wobble movement, be brought to movement with substantially less press force so that in one step substantially greater degrees of deformation and a more exacting forming of the matrix contours may be achieved. The possible feed advance during contact is determined by the angle of inclination of the wobbling tool and is thus correspondingly limited. The magnitude of this advance determines the total working stroke, i.e., for the desired degree of forming the required number of wobble passes and the corresponding wobble frequence determines the time of forming.

In known wobble presses, using mechanical drives for the wobble movement limits the rotational frequency or wobble frequency through a number of factors:

In the transverse setting of the wobbling tool, disturbing centrifugal forces originate which particularly emanate also from the large mass of the eccentric shaft and the eccentric drive components. These free forces produce prohibitive vibrations, at higher wobble frequencies, between the tool parts, thus restricting the wobble frequency in known wobble presses to low values.

The cup shaped bearing of the wobbling tool must in addition thereto absorb the entire press thrust. Due to the cup shaped formation of the upper pressure bearing, the bearing pressure increases per unit area and thus considerably increases the work produced due to friction. The thus produced frictional heat must be removed through a thin oil film from the bearing clearance. With increasing wobble frequency the friction heating increases in an analog manner, which heat must be removed through the lubricating means. On the other hand, the narrow bearing clearance limits the through-put flow of the lubrication and cooling means.

The insufficient heat removal and the centrifugal forces of the off center mass prohibit, in known constructions, the utilization of wobble frequencies more than approximately 600 revolutions per minute. If the permitted advance per wobble cycle is not exceeded, workpieces of medium dimension are turned out in forming times of approximately 4 to 5 seconds with a corresponding production capacity of only 10–12 parts per minute. During the trial at this limited wobble frequency to reduce deformation time via the increase in the closing speed of the press, did however lead to an increase in the contact area between the workpiece and the wobble tool. In this instance, a total press force would be required which is the same magnitude as in axially parallel presses so that the wobble press can in this instance not provide an essential advantage.

DESCRIPTION OF THE INVENTION

The task of the invention is to eliminate the noted deficiencies of the prior art and to provide a wobble press which permits a continuous operation with increased wobble frequency and a reduction of the shaping time of a workpiece specifically also in the mid range and the warm range.

According to the invention, this task is solved in that a first wobble driven die half which is connected with a counterweight and is thusly shaped and arranged that its center of gravity is moved 180° to the opposite side of the fulcrum point as the center of gravity of the first die half and that the product of its mass and distance to the center of gravity from the fulcrum point corresponds approximately to the product of the mass of the first die half and the distance to the center of gravity from its fulcrum point.

Since the center of gravity of the counterweight is moved 180° opposite to the center of gravity of the wobbling tool and since the products of the mass and the distance from the center of gravity cancel each other, no centrifugal forces can occur in the light of the off center location of the wobbling tool and the centrifugal forces are automatically eliminated during all wobble frequencies, wobble amplitudes and angles of inclination.

With another variation, the compensation of the forces due to inertia of the wobbling tools can be achieved in that a movable mass is proposed on the same side as fulcrum point tool. Through the movement of the counterweight to the extent of the eccentric movement of the tool to the opposing side of the center axis the necessary counter force can be produced whereby the movement of the counter mass can be achieved via a lever structure as a function of the eccentric movement.

The invention rests upon the manifestly not considered knowledge that the disadvantages of the prior art can be to a large degree obviated via the compensation of the centrifugal forces of the wobbling so that the wobble press can be operated at an increased frequency.

In a practical embodiment of the inventive wobble press, in continuous production, frequencies of about 2400 revolutions per minute and with a reduction in the deformation time to approximately 1–1.5 seconds were achieved without interfering vibrations. This short shaping time permits the expansion of wobble presses into the area of hot forming without apprehension that the tools, due to a long exposure time with the heated material wear uneconomically and at the same time that the material is subject to premature cooling during the shaping operation.

It is particularly advantageous to have exact guidance of the two die halves even with off center material distribution which can be assured in that the first die half is operatively coupled with a centering plate thus producing a practically clearance free centralization with the other die half.

In a particularly advantageous further development of the present invention the wobble drive of the first die half has at least three wobble pistons surrounding a wobble axis which are supplied via a multiple pump periodically with a cyclically varying pressure medium. Advantageously, this cyclical variation is produced via two coacting axial piston pumps with rotating angled wobble plates which affect a number of pump pistons which in turn are connected via hydraulic conduits with one each of the associated wobble pistons.

BRIEF DESCRIPTION OF THE FIGURES

The invention as well as further embodiments thereof will be further explained via the working examples depicted in the Figures. They show.

WAYS FOR THE EXECUTION OF THE INVENTION

Figure 1:
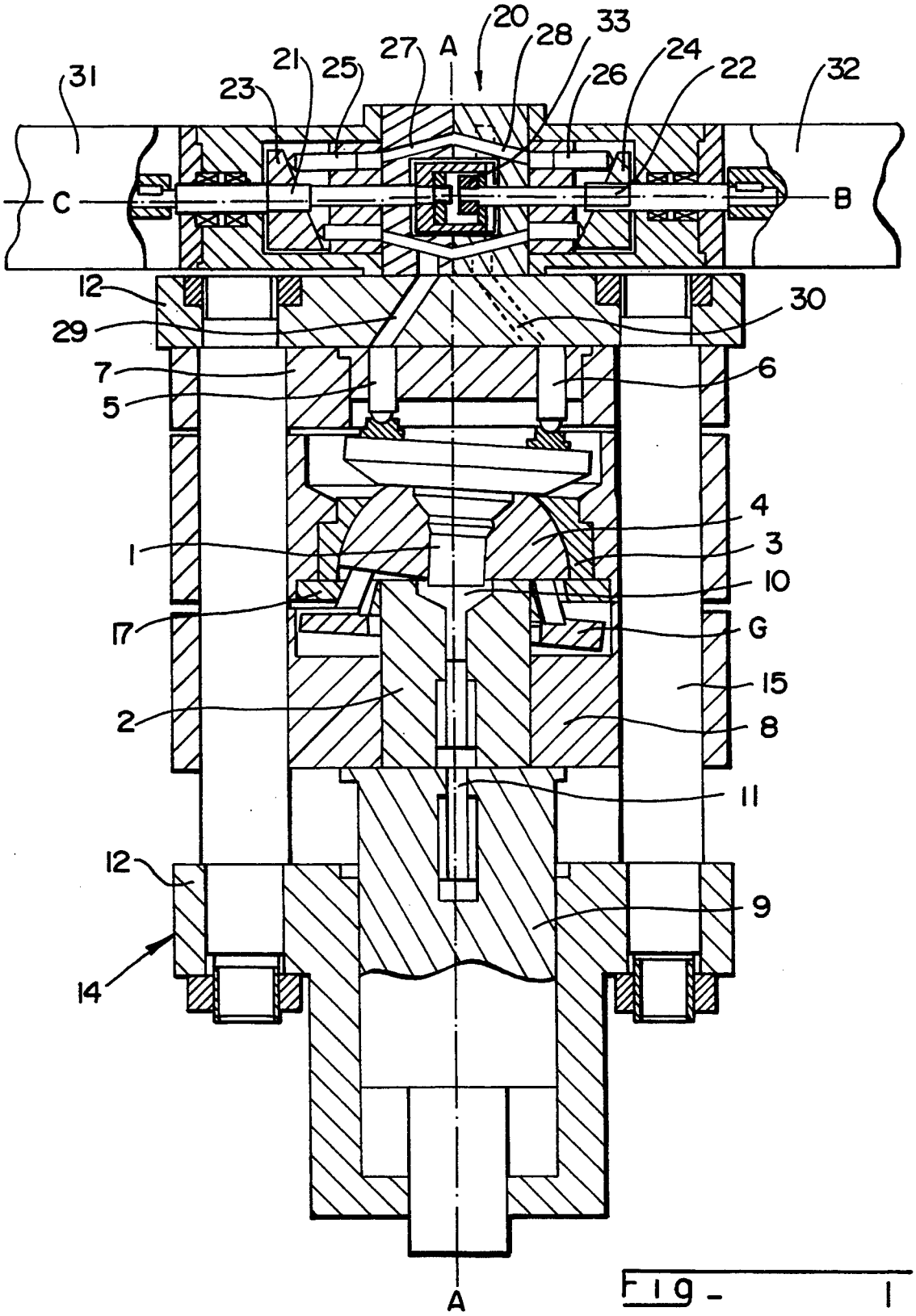
FIG. 1 is a wobble press in a longitudinal section taken along the wobble axis.
Figure 2:
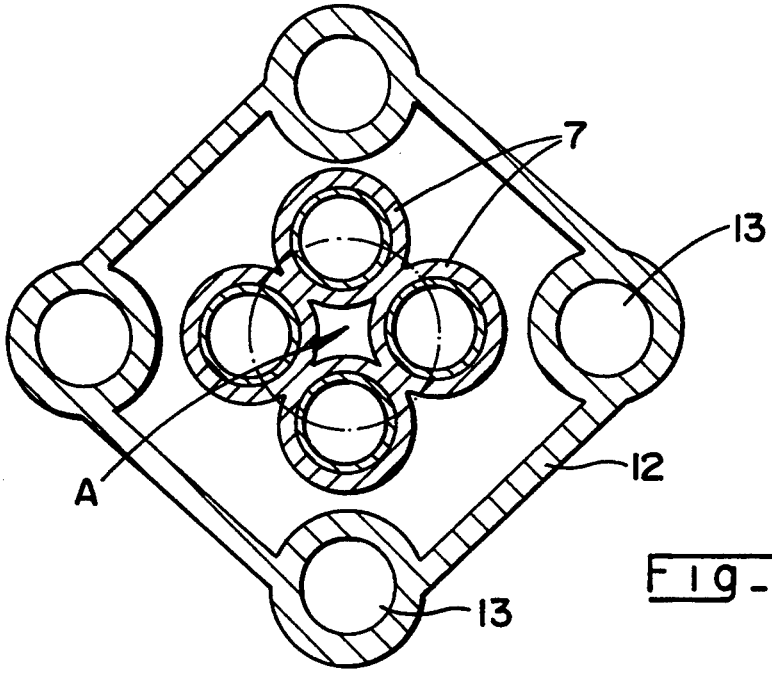
FIG. 2 is a cross-section of a wobble press of FIG. 1 along plane II.

The wobble press shown in FIG. 1, having a wobble-driven upper die half 1 and an axially parallel moving lower die half 2 and a workpiece, located between both dies 1, 2 which is to be shaped, has a press frame 12, with built-in support rods 15, a press slide 8 as well as a hydraulic sliding drive movable via piston 9. The press frame absorbs the opposing force of the pressing force developed by the press slide 8 or rather hydraulic piston 9. Press frame 12 or rather support rods 15 is formed by an upper transom 7, a lower transom 14 and a number of rotationally symmetrical columns 13 placed around press axis A. As is shown in FIG. 2, for example, four such columns 13 can be provided. In place of a column frame a box frame can also find use whereby a prismatic bed section is advantageous. The press slide 8 carries the fixed lower tool or die half and is hydraulically pressed, via piston 9 against the wobbling upper die half 1 retained in a workpiece holder.

The wobble movement of the upper die half is produced through several, at least three touching working pistons 5, 6, working through the diameter of the movable tool holder in cup 3 which pistons are impacted with a periodically sine shaped pulsating oil mass which is produced via hydraulic multiple pump with a plurality of pump piston 25, 26. The latter is comprised of two axial piston pumps 21 residing in the same axial location perpendicular to the wobble axis, each driven via electric motor 31, 32 with controllable revolutions. Both of these pumps 21, 22 work each with a surrounding dynamically balanced wobble plate to avoid centrifugal forces with wobble plates 23, 24 having a fixed inclination relative to drive axis B, respectively C in oppositely adjustable angle positions. Wobble plate 23, 24 cyclically move pump pistons 25, respectively 26 whose number corresponds to the number of working pistons 5, 6. Each pump piston 25 of one pump 21 is connected with the pump piston 26 of the other pump 22, in the same order, via hydraulic lines 27, 28 respectively connected and the hydraulic conduits 27, respectively 28 in turn are rigidly connected with pressure conduits 29, respectively, 30 of the associated work piston 5, respectively 6.

With each revolution of the pump drive shaft, respectively of wobble disks 23, 24, respectively the flow of a pump piston pair 25, 26 increases from zero at an angle of 0° to a maximum at an angle of 180° and from thereon the fluid volume is reduced until it achieves an angle of 360°. The working piston 5 which is directly connected with pump piston 25, 26 via conduit 27, 28, 29, 30 imitates this sine-shaped movement and transmits it to the wobbling tool wherein the stroke size depends upon the ratio of cross section of the pump piston to the cross section of the wobble piston. If through corresponding control of the pump motors the phase location of the wobble plates is oppositely moved, a stepless regulation of the wobble stroke of the upper workpiece can be regulated from maximum at 0° difference of the phase locations of both pumps through zero at a difference of the opposing phase locations of 180°. The drive shafts 31, 32 of the wobble plates are driven via separate motors so that in view of opposing variations of their revolutions different forms of the wobble performance of the upper workpiece can be achieved.

Figure 6A:
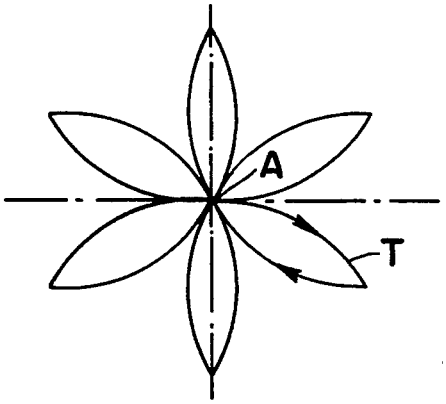
FIGS. 6*a–d* show different possible wobble movements.
Figure 6B:
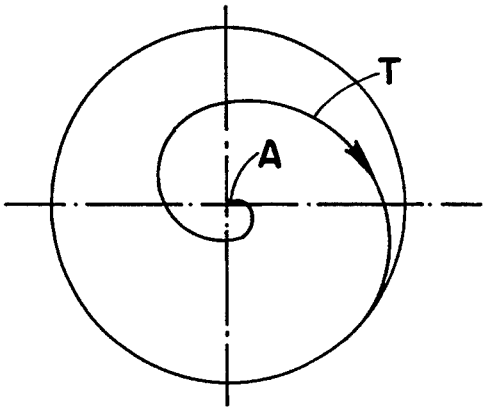
Figure 6C:
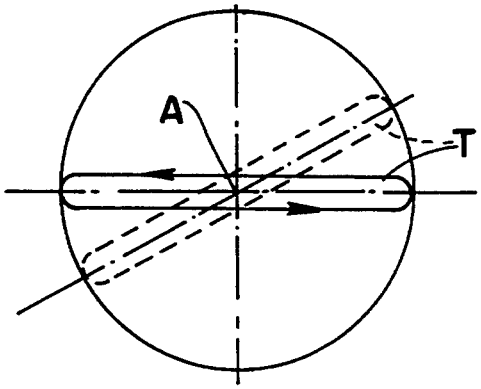
Figure 6D:
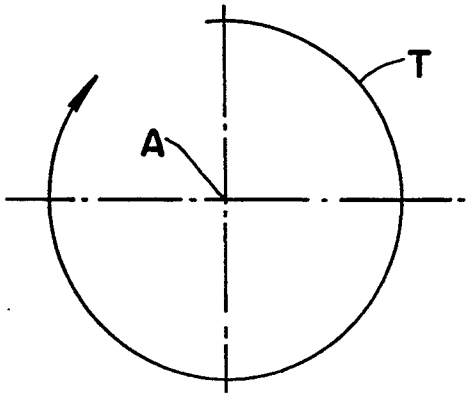

Through variation of the numbers of revolutions and the direction of rotation of pump drive motors 31, 32 all desired forms of a wobble development can be produced. FIG. 6*a* shows as example a star shaped, FIG. 6*b* a spiral shaped, FIG. 6*c* a nearly linear movement in a direction of choice, and FIGS. 6*d* a circular wobble movement T relative to wobble axis A. Due to the benefit of the minimal rotating masses and the electronic control of pump drive members 31, 32 different variations can be programmed and can be utilized within one and the same shaping operation under load.

With axial piston pumps of the described type high axial forces are encountered which are normally received via axial anti-frictions bearings. With revolutions over 2,000 rpm, the life span of such bearings is limited. With the inventive arrangement this axial load, at the ends of the pump shaft is reciprocally supported wherein due to possible difference in the number of revolutions, a pressure bearing 33 takes over the support.

Figure 3:
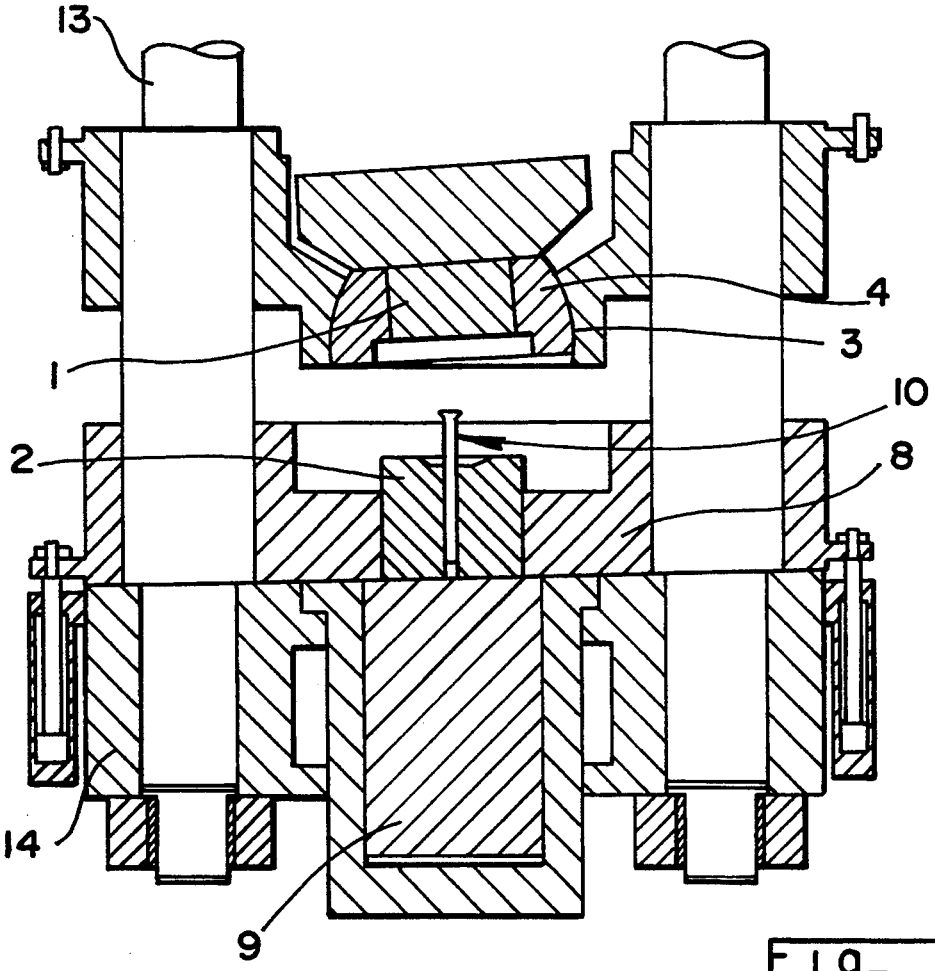
FIG. 3 is a segment of the longitudinal section of the press.

The workpiece holder 4 is particularly shown in the enlarged recitation in FIG. 3, formed in a cup shape so that the wobbling die half 1 is centered relative to fixed die half 2. Thus, the opposing pressure of the lower die half 1 is not absorbed in the cup shaped workpiece holder 4 or its guidance 3 but rather by the hydraulic medium in working pistons 5, 6.

Lower die half 2 is retained in press slide 8 which is movable via piston 9. Piston 9 includes, in addition, a hydraulically actuated ejection piston 11 for workpiece 10.

Figure 4:
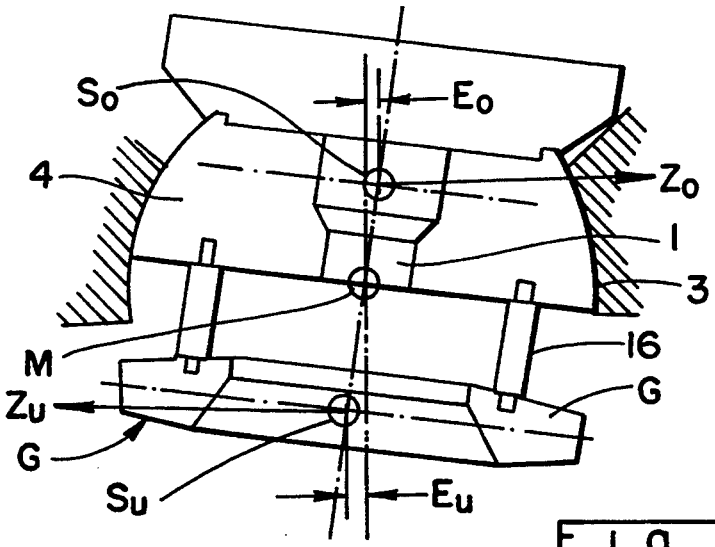
FIG. 4 is a detailed representation of the elimination of centrifugal forces.
Figure 5:
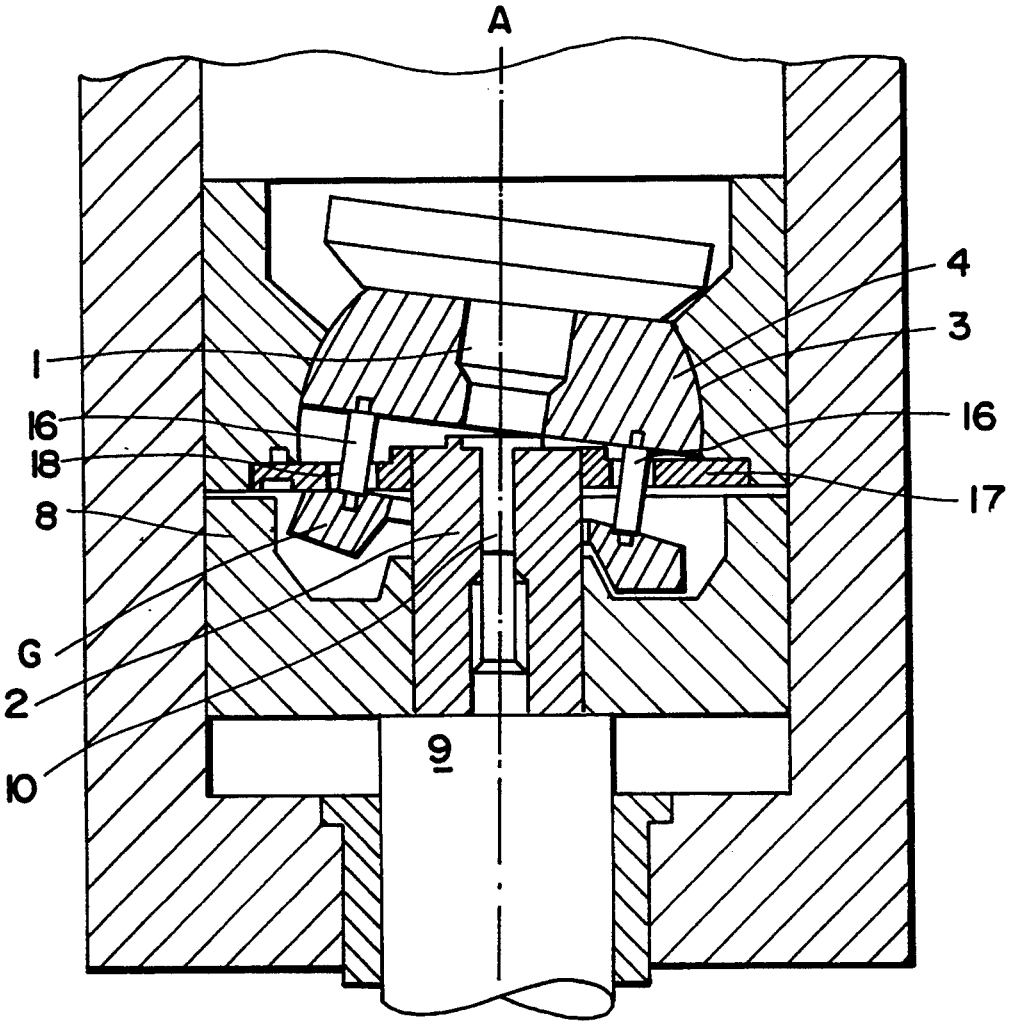
FIG. 5 is a detailed representation of the die guidance.

FIG. 4 and 5 portray in detail the construction of the upper wobbling die half 1 in which all centrifugal forces, produced in operation are compensated for. The magnitude of these centrifugal forces $Z_o$, on the upper die half 1, is determined through the eccentricity $E_o$ of the center of gravity $S_o$ relative to axis A. For compensation of the centrifugal force, a counterweight G is attached below the upper wobbling die half 1 having a center of gravity displaced 180°. The eccentricy $E_u$ and the center of gravity $S_u$ of counterweight G are so chosen so that a centrifugal force $Z_u$ is achieved in the same magnitude as the centrifugal force $Z_o$ of die half 1. For that purpose the product of the distance $E_u$ of the center of gravity $S_u$ of counterweight G from fulcrum M is chosen preferably the same as the corresponding product of the wobbly driven upper die half 1. The resultant of both centrifugal forces $Z_o$ and $Z_u$, is perpendicular to axis A then approaches zero and is indeed independent of the angle of inclination of the upper tool and of the wobble frequency. The moment produced via the axial pistons of both centrifugal forces can then be taken up without difficulty via the drive of the wobble movement.

In another variation the compensation of the natural forces of the wobbling tools can be achieved in that a movable mass is provided on the same side of the center of gravity of the tool. Through a movement of the counterweight to the extent of the eccentric deflection of the workpiece to the opposing side of the central axis the required opposing force can be achieved whereby the movement of the countermass is achieved via a lever structure as a function of the eccentric deflection.

The described compensation of the centrifugal forces permits, together with the other described requirements a striking increase in the wobble frequence of values up to approximately 2400 revolutions per minute and permits the reduction of the shaping time of the workpiece to a normal value used in drop-forging in mechanical presses, that is a noticeable increase in manufacturing output as well as the use of increased temperature of about 800° to about 1100° without excessive heating of the tools and without premature cooling of the workpiece.

In order that counterweight G takes the least possible room and is easy to store it is advantageously made of a material of a high specific weight for example from lead or other heavy metals or tungsten carbide.

For the maintenance of the centered position of both die halves and for workpieces with considerable unsymmetrical material distribution the rigidity of the opposing guidance is of considerable importance. In order to reduce the clearance in the guidance of press slide 8 and to possibly eliminate the same, a direct centering is provided. For that a centering disk 17 is directly connected with the tool holder of the upper die half which practically fits without clearance on the outer diameter of lower die half 2 and which makes a rigid connection during the deformation process. During the last portion of the deformation cycle lower die half 2 enters into centering disk 17 and assures even with noncentered workpiece material distribution the adherence of very close tolerances with reference to the axial displacement, that is even nonrotational-symmetrical distribution of the workpiece cross section assures direct tool guidance, the exact adherence of the coincidence of the axes of the two die halves.

Counterweight G which serves for the balancing of the centrifugal force is in this instance shaped as a ring and connected with wobbling upper die 1 with a plurality of spacer bolts 16. Openings or slits 16 of desired form, in centering disk 17 permit the swinging movement of spacer bolts 16.

The described embodiment is particularly advantageous with hydraulic drive since a highly stressed axial bearing is not required which at high rotational speeds would only have a short life span. The smooth running is distinctly increased and higher revolutions can be achieved in continuing operation. Through changes in the speed and the direction of rotation or movement of the phases of the two pumps, the opposing movements of both tools can readily be accommodated to technological requirements and one can depending on requirement realize, without difficulty, circular movements, spiral movements, vibratory movements or rotational movements wherein the extent of the wobble inclination and also the input of the differring movement programs can be preprogrammed and controlled without the loss of time. The upsetting process can, for example, be started with the upper tool at rest and can without delay be brought up to the desired wobble stroke.

At the end of each testing process the warm hydraulic medium circulating between the pump and the working pistons can be flushed out and possible leakages at the end of the press piston hub can be compensated for via a filling suction valve. The pressure oil heated in the process of a press cycle can at the end of the cycle be cooled with a suitable oil cooler.

What is claimed:

1. A wobble press comprising in combination: a first die half; a movable second die half axially parallel relative to the first die half; means for wobbly driving said first die half, having a mass and a center of gravity $S_o$, with regard to a longitudinal central axis (A) of said press, wobbly around a fulcrum point (M), said wobble drive means including hydraulic working pistons which are provided with a regular, defined, pulsating flow of a hydraulic medium, said hydraulic working pistons being connected with said first die half for the generation of a wobble movement; a counterweight (G), having a mass and a center of gravity ($S_u$), connected to said first wobbly driven die half, said counterweight (G) being so structured and arranged that the product of the mass of said counterweight (G) and the eccentricity spacing ($E_u$), of the spacing of the center of gravity. ($S_u$) of said counterweight (G), relative to longitudinal axis (A), at least approximately corresponds to the product of the mass of said first die half and the eccentricity spacing ($E_o$), of the spacing of the center of gravity ($S_o$) of said first die half, relative to longitudinal axis (A), so that the centrifugal forces of both said counterweight (G) and said first die half at least approximately compensate each other.

2. The wobble press of claim 1, wherein said counterweight (G) is thusly arranged that its center of gravity ($S_u$) lies on the opposed side of the fulcrum (M) of the wobble movement as the center of gravity ($S_o$) of said first die half, and that the product of said counterweight mass and its eccentricity spacing ($E_u$) relative to the fulcrum point (M) of the wobble movement at least approximately corresponds to the product of the mass of said first die half and its eccentricity ($E_o$) relative to fulcrum point (M).

3. The wobble press of claim 1 wherein said counterweight (G) consists of a material with a high specific weight, specifically over 10 g/cm$^2$.

4. The wobble press of claim 3 wherein said material is one of lead and tungsten carbide.

5. The wobble press of claim 1 wherein a centering disk is arranged axially below and operatively interconnected with said first wobbling die half, said centering disk couplingly centering said first wobbling die half relative to said second die half.

6. The wobble press of claim 5, wherein said counterweight (G) is arranged axially below said centering plate and is connected with said first die half through openings in said centering plate.

7. The wobble press of claim 6, wherein said counterweight (G) annularly surrounds said second die half.

8. The wobble press of claim 1, wherein said wobble drive of the first die half has at least three pump-working piston-systems surrounding the wobble axis, and a multiple pump for supplying said pump-working piston-system with cyclically varying amounts of oil.

9. The wobble press of claim 8, wherein said multiple pump has two oppositely acting axial piston pumps at equal axial location.

10. The wobble press of claim 8, wherein both of said axial piston pumps each have a wobble plate of fixed angulation, as well as each having a number of pump pistons corresponding to the number of said working pistons, whose hydraulic conduits are connected in pairs with each other and with a pressure conduit of each assigned working piston.

11. The wobble press of claim 10, including means for the variation of the wobble stroke of the first die half, said means being provided via displacement of the phase location of both of said synchronously rotating pumps.

12. The wobble press of claim 10, including means for the variation of one of the number of revolutions and the direction of rotation of both pumps for attaining differing forms of wobble movement of said first die half.

* * * * *